United States Patent [19]

Rudolf et al.

[11] 4,421,032

[45] Dec. 20, 1983

[54] AMMUNITION

[75] Inventors: Karl Rudolf, Schrobenhausen; Helmut Hessberg, Sünzhausen, both of Fed. Rep. of Germany

[73] Assignee: Messerschmitt-Bölkow-Blohm Gesellschaft mit beschränkter Haftung, Munich, Fed. Rep. of Germany

[21] Appl. No.: 186,614

[22] Filed: Sep. 2, 1980

[30] Foreign Application Priority Data

Sep. 12, 1979 [DE] Fed. Rep. of Germany ..... 2936749

[51] Int. Cl.[3] ..... F42B 1/02

[52] U.S. Cl. ..... 102/307; 102/518; 102/211

[58] Field of Search ..... 102/211, 306–310, 102/517–519

[56] References Cited

U.S. PATENT DOCUMENTS

| | | | |
|---|---|---|---|
| 3,136,249 | 7/1964 | Poulter | 102/309 |
| 3,186,304 | 6/1965 | Biehl | 102/306 X |
| 3,255,659 | 6/1966 | Venghiattis | 102/306 X |
| 3,532,056 | 10/1970 | Irion | 102/517 X |
| 3,861,311 | 1/1975 | Bilsbury | 102/518 X |
| 3,995,574 | 12/1976 | Drimmer | 102/211 X |
| 4,281,599 | 8/1981 | Weber et al. | 102/518 X |
| 4,306,502 | 12/1981 | Romer et al. | 102/309 X |

*Primary Examiner*—Peter A. Nelson

[57] ABSTRACT

Ammunition for combatting armored targets includes a flying body with an impact end and a trailing end. A penetrating warhead is located within the flying body spaced from the impact end. Between the impact end and the warhead, a projectile in the form of a plate of inert material is provided. The surface of the plate facing the warhead is covered with an explosive charge. When the flying body impacts against a target, first the plate-shaped projectile forms an opening through the target sufficient for the warhead to pass through the opening to the interior of the target.

3 Claims, 7 Drawing Figures

AMMUNITION

The invention relates to ammunition for combatting armored targets.

As is known, hollow charges, flat charges and customary projectile-forming charges which are, among others, commonly used for this purpose, distinguish themselves by high depth effects. The hole-like channels which are generated by them in the target material, have, by contrast, always cross-sections which, without exception, are much too small for permitting unobstructed penetration into the interior of the target of following warheads of the same or similar caliber.

In the final result, for this reason, the previous concepts for penetrating warheads for semi-armored targets, are directed to overcoming solely the outer boundary of the target by the warhead envelope which latter is provided with kinetic energy. The warhead envelope therefore has to have a very massive and stable outer structure which, of course, is at the expense of the explosive charge components.

The present invention is based on the task to develop ammunition of the kind mentioned hereinabove, which is simple to produce and which reliably functions, with which ammunition, without significant expenditure in material, much larger penetrations through outer walls of lightly or semi-armored targets can be realized, than with an ordinary hollow charge, flat charge or projectile-forming charges with a caliber of the same size.

The task is solved according to clause of claim 1 a projectile of inert material such as steel, which is formed as a form-stable plate and has an explosive charge on the rear side of the plate for accelerating the plate as a total unit in the direction toward the target in a predetermined target distance.

The measures which are taken in accordance with the invention may be realized in a simple and cost-saving manner. A plate charge results from these measures which is capable of causing a hole in target material of light or average strength armor, of a clear width which is in the magnitude of that caliber which the plate charge has prior to the explosion-technical acceleration of its plate. This is so, because the explosion-technically accelerated plate, in contrast to the linings of hollow charges, coatings of flat charges and coatings of ordinary projectile-forming charges, becomes active in the target material with a diameter which corresponds to its diameter prior to the explosion-technical acceleration, or deviates from the latter diameter only insignificantly upwardly or downwardly.

In this connection it remains to refer to the readily available possibility of controllably preventing damage to the plate structure by peeling or chipping effects. This can be done by the shape of the plate, the dimensions of the plate, choice of plate material, the magnitude of the plate acceleration and the plate distance to the target at the start of the acceleration.

If the inventive ammunition is a flying body with a penetrating warhead, then the target effect of the penetrating warhead can be significantly increased. In that case, prior to contact of the latter with the target, there occurs an effective pre-weakening of the target by virtue of the plate of the timely activated plate charge, which plate, in the vicinity of the target, is significantly ahead of the warhead with a significant velocity differential. In a target outer wall of light strength armor or armor of the average strength type, this pre-weakening causes a hole with an inner diameter in the magnitude of the warhead caliber. Through a hole of such dimensions, the warhead is capable of further penetrating into the interior of the target without or only with insignificant obstructions. Contrary to the results obtained in the absence of the described target pre-weakening, only very reasonable stresses result on the outer structure of the target, even at high flying speeds and inclined trajectory towards the target. Thus one can eliminate the massive and stable construction for warhead outer structures which, prior to this invention, was required for such warheads. This is to the benefit of a correspondingly higher explosive charge component in the total warhead mass, which is beneficial for the effect in the interior of the target.

Embodiments of the invention are in the following further explained by way of diagrammatical drawings. In the form of sketches showing the principle;

Figure 1:
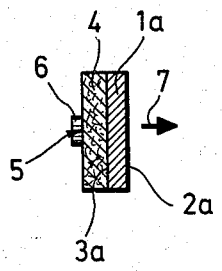
FIGS. 1 through 4 show different ammunition embodiments with a plate as inert material, which without or at least without significant change of form can be accelerated in explosion-technical manner.

FIG. 1 shows a plate 1*a* of steel or the like inert material with a front side 2*a* of plane configuration and a rear side 3*a*, also of plane configuration. An explosive charge 4 is adjacent the latter over the entire area. An igniter 6 is associated with the explosive charge 4 for centric charge initiation at 5. In case of initiation of the charge, there occurs an acceleration of the plate 1*a* in the direction of the arrow 7, to wit, without or at least without significant changes of plate form and plate size.

Figure 2:
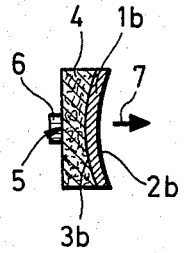
Figure 3:
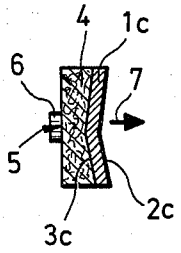
Figure 4:
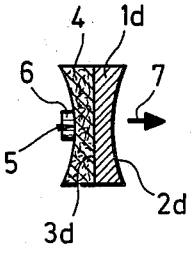

The same applies also for the embodiments of FIGS. 2 through 4, wherein, as in FIG. 1, explosive charge and igniter are indicated by reference numerals 4 and 6, respectively. In FIG. 2, the plate 1*a* of inert material, which is plane on both sides, has been replaced by a plate 1*b* with concave front side 2*b* and convex rear side 3*b*. In contrast thereto, the plate charge of FIG. 3 has a plate 1*c* made of inert material such as steel, wherein front side 2*c* and rear side 3*c* have cone-shaped configuration. FIG. 4 shows finally a plate 1*d* of inert material, whose plate thickness, as a result of concave configuration of its front side 2*d* and a plane configuration of its rear side 3*d*, increases radially from the interior outwardly.

Figure 5:
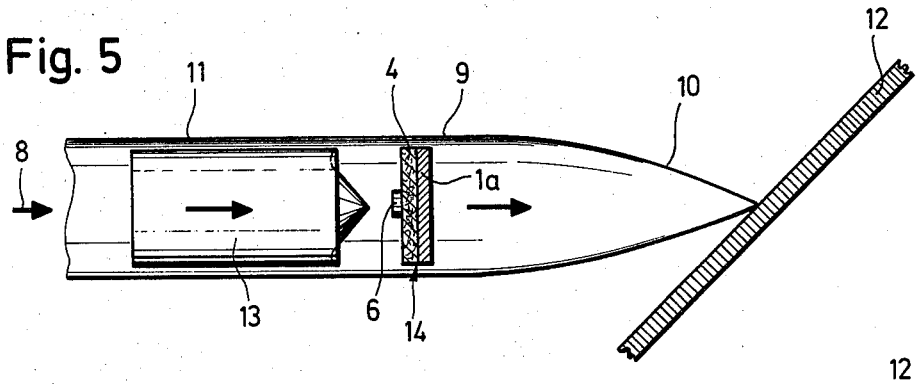
FIG. 5 shows a flying body with a penetrating warhead and a plate charge arranged ahead of the warhead as it is, for example, shown in FIG. 1, the figure showing the moment of the target contact with the hood of the warhead.

In FIG. 5, a flying body 9 has approached a semi-armored target object, along the arrow direction 8, with a speed $V_o$. The approach is to such an extent that between its ogival nose or hood 10 and the outer wall of the target 12 there has just been established contact.

The flying body 9 offers space in its outer hood or casing 11 for, among others, a penetrating warhead 13 as well as a plate charge 14, for example, the plate charge of FIG. 1. The plate charge 14, which may be replaced by one of the charges corresponding to FIGS. 2 through 4, is arranged coaxially ahead of the warhead 13. This is done at a distance to the forward flying body end which serves as an acceleration path for the plate 1*a* and at a distance which, during the detonating conversion of its explosive charge 4, excludes disturbing influences on the warhead 13.

Figure 6:
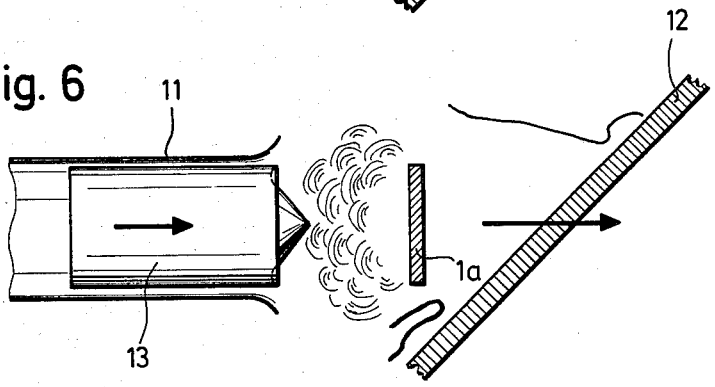
FIG. 6 shows a warhead and plate charge according to FIG. 5, after acceleration has taken place in direction towards the target.

A distance igniter serves as igniter 6 in this embodiment and is associated with the explosive charge 4. The distance igniter may, for example, respond, when the flying body hood 10 comes into contact with the target, In view thereof, the initiation of the explosive charge 4 will take place timely prior to contact of the warhead 13 with the target. As a consequence of this charge initiation, the plate 1*a*, as a total, moves ahead of the warhead 13 on its path toward the target, with a significant speed differential, as is shown in FIG. 6.

Figure 7:
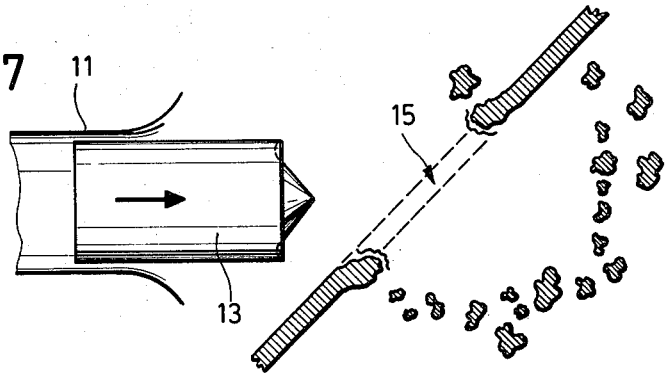
FIG. 7 shows the target pre-weakening which can be obtained in a lightly armored or average strength armored target outer wall, with a plate accelerated pursuant to FIG. 6.

The pre-weakening, which is imparted to the outer wall of the target 12 by the plate 1*a* accelerated in this manner, is shown in FIG. 7. It consists of a hole 15 with a clear width in the magnitude of the caliber of the warhead through which the subsequent warhead 13 can penetrate further without, or at least without significant, structural stresses into the interior of the target.

We claim:

1. Ammunition for combatting armored targets, comprising a projectile of inert material formed as a formstable plate having a first face surface arranged to face the target, an oppositely directed second face surface, and a peripheral edge surface extending around and between said first and second face surfaces, an explosive charge located on and covering said second face surface of said place for accelerating said plate as a unit thereby retaining substantially the original shape and dimension of said plate in direction toward the respective target from a pre-determined target distance.

2. Ammunition according to claim 1, wherein said plate has at the peripheral edge surface a greater thickness than in the central plate region spaced inwardly from the peripheral edge surface.

3. Ammunition according to claim 1 or 2 comprising a flying body having an impact end and a trailing end, a penetrating warhead located within said flying body said plate located within said flying body and spaced rearwardly from the impact end and forwardly from said warhead for precluding interaction therebetween, said plate has a caliber in the magnitude of the warhead caliber and said explosive charge on the second face surface of said plate is caused to detonate prior to target contact of the penetrating warhead.

* * * * *